US010838346B2

(12) United States Patent
Egi

(10) Patent No.: US 10,838,346 B2
(45) Date of Patent: Nov. 17, 2020

(54) IMAGE FORMING APPARATUS

(71) Applicant: KYOCERA Document Solutions Inc., Osaka (JP)

(72) Inventor: Makoto Egi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 207 days.

(21) Appl. No.: 16/149,810

(22) Filed: Oct. 2, 2018

(65) Prior Publication Data

US 2019/0196385 A1 Jun. 27, 2019

(30) Foreign Application Priority Data

Dec. 22, 2017 (JP) ..... 2017-246525

(51) Int. Cl.
*G03G 21/06* (2006.01)
*G03G 15/00* (2006.01)

(52) U.S. Cl.
CPC ..... *G03G 15/6529* (2013.01); *G03G 15/657* (2013.01); *G03G 21/06* (2013.01)

(58) Field of Classification Search
CPC ..... G03G 21/06
USPC ..... 399/400
See application file for complete search history.

(56) References Cited

U.S. PATENT DOCUMENTS 4,009,047 A * 2/1977 Lindsay ..... B08B 7/0028 134/9
4,994,861 A * 2/1991 Brandon ..... G03G 15/6552 271/208
6,128,463 A * 10/2000 Matsumoto ..... G03G 15/231 399/364
8,571,453 B2 * 10/2013 Enomoto ..... G03G 15/657 399/315
2007/0098472 A1 * 5/2007 Saeki ..... G03G 15/657 399/400
2007/0147920 A1 * 6/2007 Shimizu ..... G03G 15/657 399/400
2012/0230746 A1 * 9/2012 Namisaki ..... G03G 15/2028 399/400

(Continued)

FOREIGN PATENT DOCUMENTS

JP 2004-284723 A 10/2004

*Primary Examiner* — Anthony H Nguyen
(74) *Attorney, Agent, or Firm* — Stein IP, LLC

(57) ABSTRACT

An image forming apparatus includes an image carrier, a transfer portion, a fixing portion, a recording medium conveying passage, and a static eliminating member. The image carrier carries a toner image. The transfer portion transfers the toner image formed on the image carrier to a recording medium. The fixing portion fixes the toner image transferred by the transfer portion to the recording medium. Through the recording medium conveying passage, the recording medium conveyed from the transfer portion to the fixing portion passes. A plurality of static eliminating members are arranged in the recording medium conveying passage along the conveying direction of the recording medium in a non-contact state with the recording medium. The static eliminating member arranged on the downstream side in the conveying direction of the recording medium has a larger electric charge capacity than that of the static eliminating member arranged on the upstream side.

6 Claims, 7 Drawing Sheets

(56) References Cited

U.S. PATENT DOCUMENTS

| | | | | |
|---|---|---|---|---|
| 2015/0110528 | A1* | 4/2015 | Kuma | G03G 15/657<br>399/315 |
| 2018/0032003 | A1* | 2/2018 | Phelps | G03G 15/657 |
| 2018/0136592 | A1* | 5/2018 | Takahashi | G03G 15/657 |

* cited by examiner

IMAGE FORMING APPARATUS

INCORPORATION BY REFERENCE

This application is based upon and claims the benefit of priority from the corresponding Japanese Patent Application No. 2017-246525 filed on Dec. 22, 2017, the entire contents of which are incorporated herein by reference.

BACKGROUND

The present disclosure relates to image forming apparatuses using an electrophotographic system, such as copiers, printers, facsimile machines, and multifunction peripherals incorporating their functions, and also relates to image forming apparatuses provided with a conveying guide for conveying to a fixing portion a recording medium such as a sheet on which a toner image on an image carrier has been transferred at a transfer portion.

In image forming apparatuses using the electrophotographic system such as copiers, printers, and facsimile machines, developer (toner) that is typically powdery is used. In a conventionally common process, a photosensitive layer on the surface of a photosensitive drum (image carrier) is electrostatically charged to a predetermined surface potential (with the same polarity as the charging polarity of the toner) by a charging device, and then an electrostatic latent image is formed on the photosensitive drum by an exposure device. Then, the formed electrostatic latent image is visualized by the toner in the developing device, and the toner image is transferred to a sheet (recording medium) which passes through the transfer portion facing the photosensitive drum; then fixing is performed in the fixing portion.

On the other hand, according to a known structure, a metal conveying guide is arranged in a sheet conveying passage extending from a transfer portion to a fixing portion, and by conveying a sheet while attracting it toward the conveying guide, the behavior of the sheet is stabilized. In this structure, if a large quantity of electric charge is left on the sheet on which the toner image has been transferred, micro-discharges may occur between the sheet and the metal guide. As a result, unfixed toner on the sheet may scatter and cause disturbances in the toner image. Or, scattered unfixed toner may attach to the conveying guide or a fixing member and then attach back to the following sheet, soiling the sheet.

Thus, in another known image forming apparatus, in order to adequately remove electric charges on a transfer material on which a toner image has been transferred, a static-eliminating means is provided on the downstream side of a transferring means in the conveying direction of the transfer material, and an electrically conductive fibrous member is arranged on the downstream side of the static-eliminating means in the conveying direction of the transfer material.

SUMMARY

An image forming apparatus according to one aspect of the present disclosure includes an image carrier, a transfer portion, a fixing portion, a recording medium conveying passage, and a static eliminating member. The image carrier carries a toner image. The transfer portion transfers the toner image formed on the image carrier to a recording medium. The fixing portion fixes the toner image transferred by the transfer portion to the recording medium. Through the recording medium conveying passage, the recording medium conveyed from the transfer portion to the fixing portion passes. A plurality of static eliminating members are arranged in the recording medium conveying passage along the conveying direction of the recording medium in a non-contact state with the recording medium. The static eliminating member arranged on the downstream side in the conveying direction of the recording medium has a larger electric charge capacity than that of the static eliminating member arranged on the upstream side.

This and other objects of the present disclosure, and the specific benefits obtained according to the present disclosure, will become apparent from the description of embodiments which follows.

DETAILED DESCRIPTION

Figure 1:
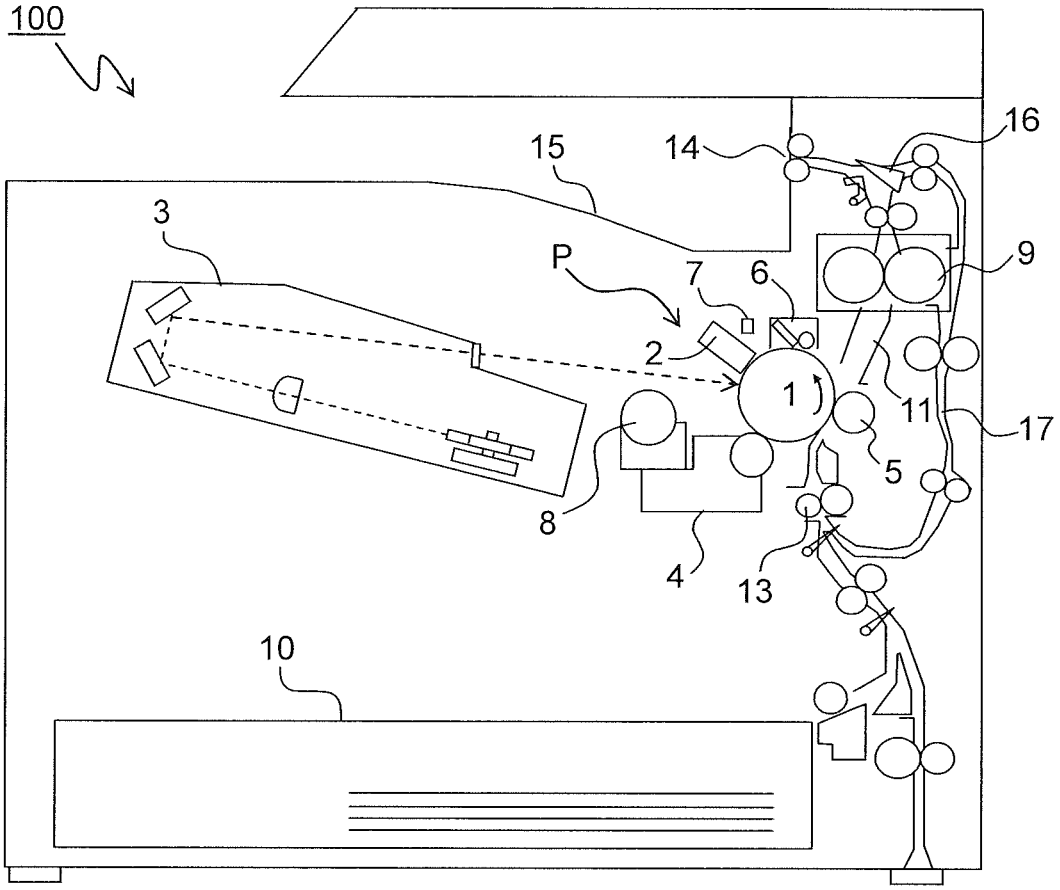
FIG. 1 is a schematic cross-sectional view showing the overall structure of an image forming apparatus according to a first embodiment of the present disclosure.

Hereinafter, with reference to the accompanying drawings, embodiments of the present disclosure will be described. FIG. 1 is a schematic diagram showing the overall structure of an image forming apparatus 100 according to a first embodiment of the present disclosure. Inside the main body of the image forming apparatus (for example, a monochrome printer) 100, there is arranged an image forming portion P that forms a monochrome image through processes of charging, exposure, development, and transfer.

In the image forming portion P, there are arranged, along the rotating direction of the photosensitive drum 1 (in the counter-clockwise direction in FIG. 1), a charging device 2, an exposure device 3, a developing device 4, a transfer roller 5, a cleaning device 6, and a static eliminator 7. The image forming portion P, while rotating the photosensitive drum 1 in the counter-clockwise direction in FIG. 1, performs an image forming process with respect to the photosensitive drum 1.

The photosensitive drum 1 is, for example, a drum tube of aluminum coated with a photosensitive layer around its outer circumferential face. In this embodiment, as the photosensitive layer, an amorphous silicon (a-Si) photosensitive layer which has high hardness and excels in durability is used. The photosensitive layer does not necessarily have to be an amorphous silicon photosensitive layer. Instead, an organic photosensitive layer (OPC) may also be used.

The charging device 2 electrostatically charges the photosensitive layer of the photosensitive drum 1 uniformly. In this embodiment, a charging device using a roller charging system is used. In this charging system, a charging roller is brought into contact with the photosensitive drum 1 so that an electric field generated near their contact portion causes electrical discharge. This is not meant as any limitation on the charging device 2. Instead, a scorotron charging system using a corona wire may also be used.

The exposure device 3 irradiates the photosensitive drum 1 with a light beam based on image data, and forms an electrostatic latent image on the surface of the photosensitive layer of the photosensitive drum 1 by attenuating the electrostatic charge. The developing device 4 attaches toner to the electrostatic latent image to form a toner image. The toner is fed to the developing device 4 from a toner container 8.

The transfer roller 5 forms a transfer nip portion N (see FIG. 4) at a contact position with the photosensitive drum 1. With a voltage of a negative polarity (the polarity opposite to that of toner) applied to the transfer roller 5 from a transfer voltage power source (unillustrated), when a sheet passes through the transfer nip portion N, the toner image formed on the photosensitive drum 1 is attracted toward the transfer roller 5 into which electric charge of the negative polarity is injected, and is transferred to the sheet.

The cleaning device 6, after the toner image has been transferred to the sheet, removes residual toner on the surface of the photosensitive drum 1. The static eliminator 7 irradiates the surface of the photosensitive drum 1 with static-eliminating light to remove residual electric charges.

When printing operation is performed, image data transmitted from a host device such as a personal computer is converted to an image signal. On the other hand, in the image forming portion P, the charging device 2 electrostatically charges the photosensitive drum 1 uniformly which rotates in the counter-clockwise direction in the diagram. Then, the exposure device 3 irradiates the photosensitive drum 1 with a light beam based on the image signal, and an electrostatic latent image based on the image data is formed on the surface of the photosensitive drum 1. Then, the toner carried by the developing roller in the developing device 4 attaches to an electrostatic latent image to form a toner image.

Toward the image forming section P, where the toner image has now been formed as described above, a sheet is conveyed with predetermined timing from a sheet storage portion 10 via a sheet conveying passage 11 and a registration roller pair 13, and the toner image on the surface of the photosensitive drum 1 is transferred to the sheet at the nip portion N between the photosensitive drum 1 and the transfer roller 5. The sheet having the toner image transferred to it is separated from the photosensitive drum 1, and is conveyed to a fixing portion 9, where, under application of heat and pressure, the toner image is fixed onto the sheet. The sheet having passed through a fixing portion 9 has its conveying direction switched by a branch guide 16 which is arranged at a branch portion of the sheet conveying passage 11, and then (or after being conveyed to a reversing conveying passage 17 and having its both faces printed) is discharged to a sheet discharge portion 15 via a discharge roller pair 14.

Figure 2:
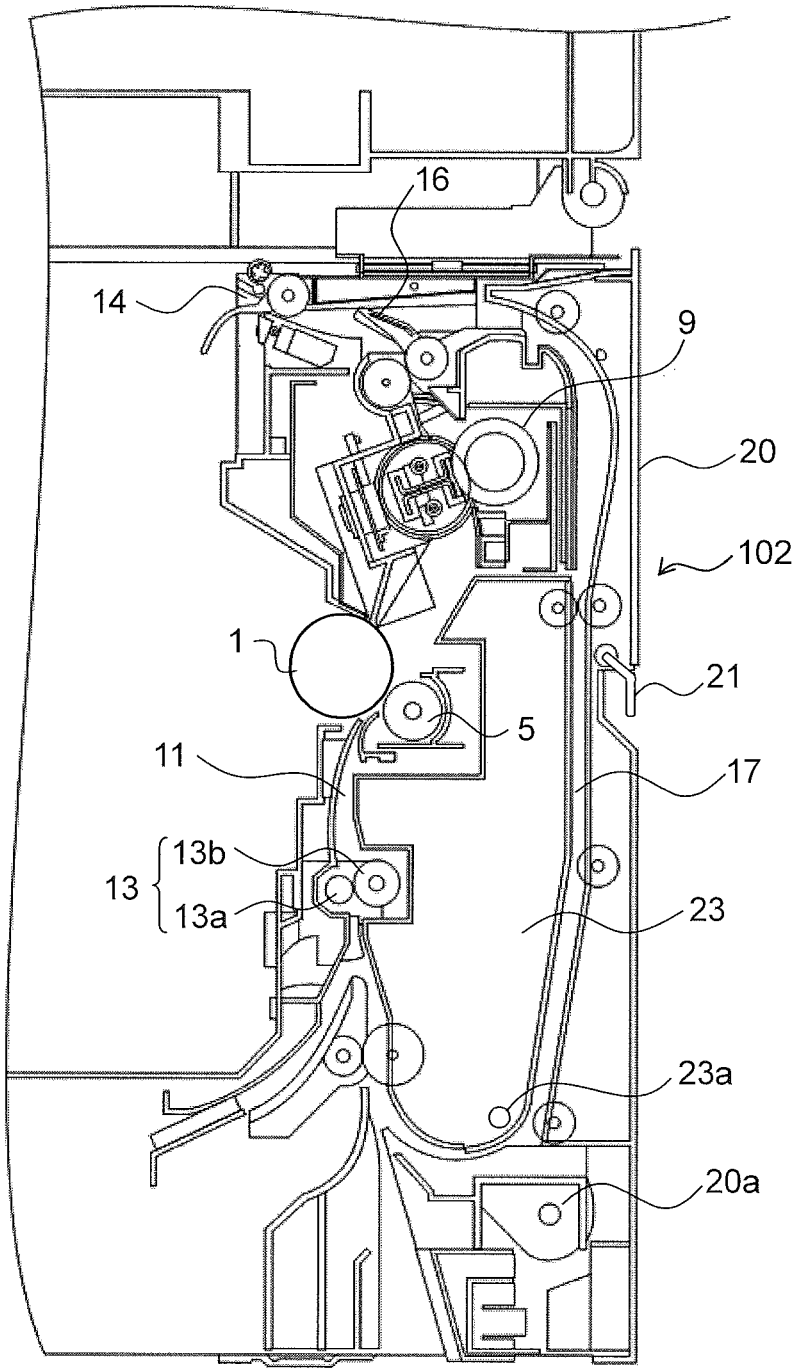
FIG. 2 is a partial cross-sectional view of and around a sheet conveying passage and a reversing conveying passage in the image forming apparatus according to the first embodiment.

FIG. 2 is a partial cross-sectional view of and around the sheet conveying passage 11 and the reversing conveying passage 17 in the image forming apparatus 100 according to the first embodiment. A side cover 20 constitutes a side face 102 of the image forming apparatus 100, and is pivotably supported by a pivot 20*a* arranged in a lower part of the image forming apparatus 100 main body. On the side edge of the side cover 20, a hook 21 is provided. The hook 21, by engaging with an engagement pin (unillustrated) arranged on a front-side frame and a back-side frame of the image forming apparatus 100, keeps the side cover 20 closed. An inner face of the side cover 20 constitutes one conveying face of the reversing conveying passage 17.

Inside the side cover 20, a conveying unit 23 is arranged. The conveying unit 23 is supported on the image forming apparatus 100 main body so as to be pivotable about the pivot 23*a* and constitutes a part of the conveying faces of the reversing conveying passage 17 and the sheet conveying passage 11. The reversing conveying passage 17, lying between the inner face of the side cover 20 and the outer face of the conveying unit 23, extends in the up-down direction along the side face 102 of the image forming apparatus 100, and is curved substantially in a C shape to join the sheet conveying passage 11. On the inner face of the conveying unit 23, a roller 13*b*, which is one of the rollers constituting the registration roller pair 13, and the transfer roller 5 are provided in the order named from the upstream side (lower side in FIG. 2) in the sheet conveying direction.

Pivoting only the side cover 20 in the opening direction relative to the image forming apparatus 100 permits the reversing conveying passage 17 to be exposed over a wide range. Pivoting the side cover 20 together with the conveying unit 23 in the opening direction causes the conveying unit 23 to move away from the image forming apparatus 100 main body, permitting the sheet conveying passage 11 to be exposed over a wide range. On the other hand, pivoting the side cover 20 together with the conveying unit 23 in the closing direction causes the conveying unit 23 to touch the image forming apparatus 100 main body, causing the transfer roller 5 is pressed against the photosensitive drum 1.

Figure 3:
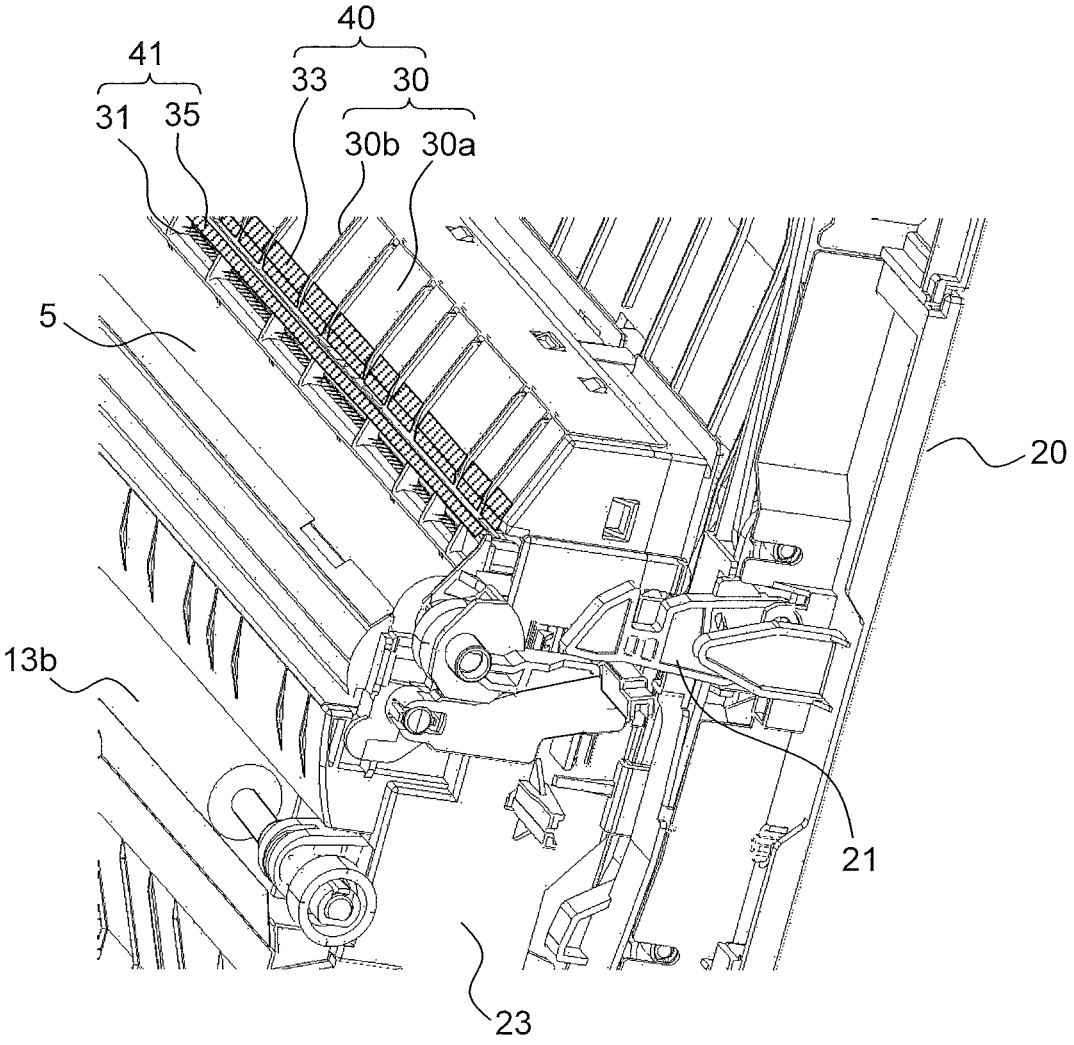
FIG. 3 is a perspective view of and around a first conveying guide and a second conveying guide which are arranged in a conveying unit in the image forming apparatus according to the first embodiment, as seen from the front side of the image forming apparatus.
Figure 4:
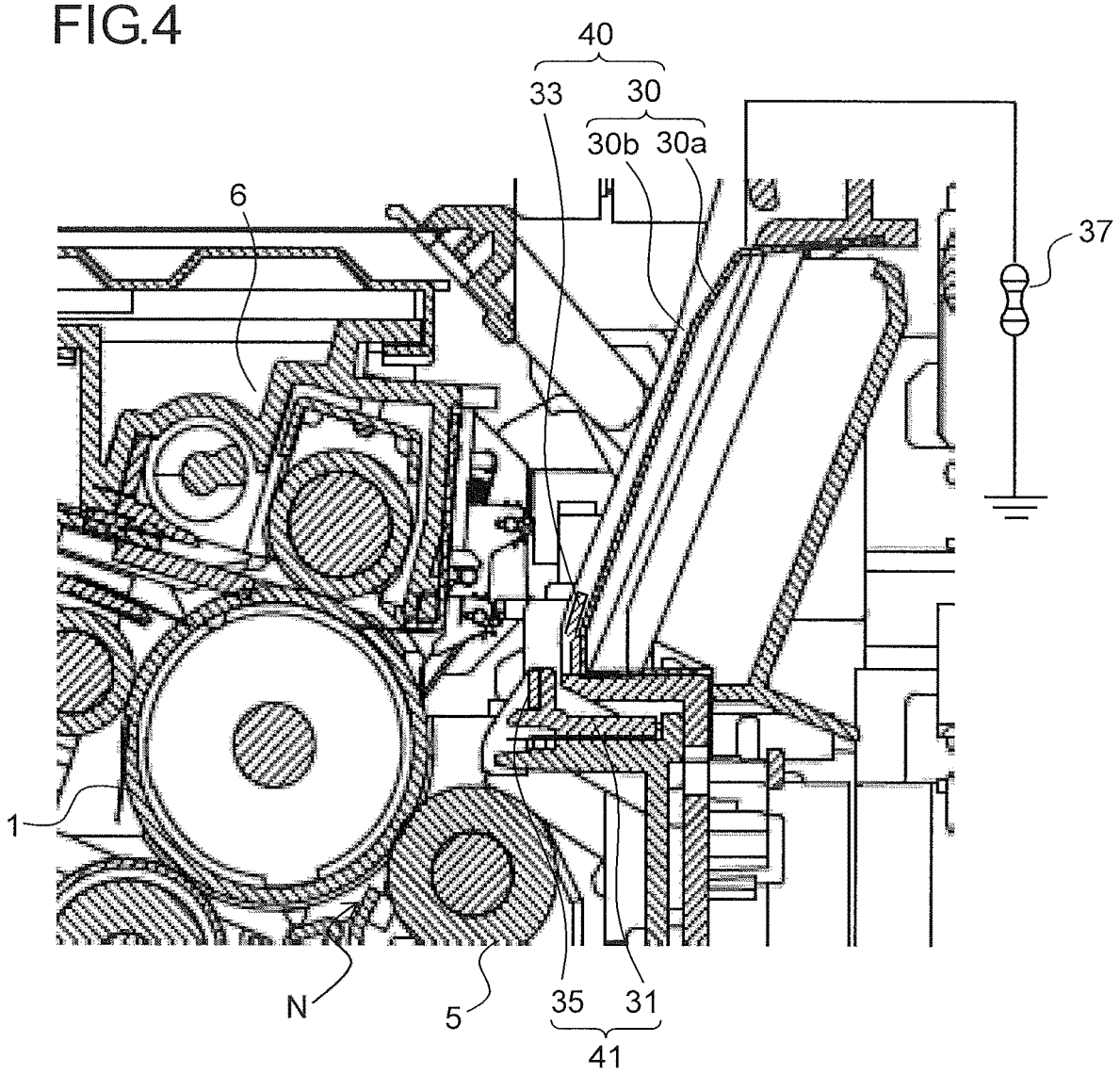
FIG. 4 is an enlarged cross-sectional view of and around the first conveying guide and the second conveying guide in the image forming apparatus according to the first embodiment.

FIG. 3 is a perspective view of and around a first conveying guide 30 and a second conveying guide 31 which are arranged in the conveying unit 23 in the image forming apparatus 100 according to the first embodiment, as seen from the front side of the image forming apparatus 100. FIG. 4 is an enlarged cross-sectional view of and around the first conveying guide 30 and the second conveying guide 31 in the image forming apparatus 100 according to the first embodiment. As shown in FIGS. 3 and 4, the first conveying guide 30 and the second conveying guide 31 are arranged in the conveying unit 23. The first conveying guide 30 and the second conveying guide 31 guide the sheet that has passed through the transfer nip portion N in the sheet conveying passage 11 on the downstream side of the transfer roller 5 to the fixing portion 9.

The first conveying guide 30 has a guide plate 30*a* formed by bending a metal plate in a predetermined shape and resin guide ribs 30*b* arranged so as to protrude from the surface of the guide plate 30*a*. The guide plate 30*a* is grounded (earthed) via a resistor 37 (Hi-Meg resistor) which has a resistance value of the order of megohms ($10^6\Omega$).

A plurality of guide ribs 30*b* are arranged at predetermined intervals in the sheet width direction (the direction perpendicular to the plane of FIG. 4) perpendicular to the sheet conveying direction. Conveying a sheet along the guide ribs 30*b* allows the sheet and the guide plate 30*a* to be kept in a non-contact state.

The second conveying guide 31 is formed of resin, and is arranged between the transfer roller 5 and the first conveying guide 30.

As mentioned above, if a large quantity of electric charge is left on the sheet to which a toner image has been transferred at the transfer nip portion N, micro-discharges may occur between the sheet and the metal guide plate 30*a*. Thus, a first static eliminating sheet 33 for removing residual electric charges on the sheet is attached to the guide plate 30*a*.

The first static eliminating sheet 33 is attached to the first conveying guide 30 on its upstream side (lower side in FIGS. 3 and 4) in the sheet conveying direction, over the entire region of the first conveying guide 30 in its width direction (direction perpendicular to the plane of FIG. 4) so as to fill the gaps between the guide ribs 30*b*. The first conveying guide 30 (guide plate 30*a*) and the first static eliminating sheet 33 constitute a first static eliminating member 40 used in this embodiment. As a material of the first static eliminating sheet 33, an electrically conductive nonwoven fabric or the like is used.

However, if the static eliminating effect on a sheet by the first static eliminating member 40 is too strong, when a sheet passes through the first static eliminating member 40, micro-discharges occur between the sheet and the first static eliminating sheet 33, causing image degradation. Changes in the distance between a sheet and the first static eliminating sheet 33 due to variation of the sheet conveying state makes micro-discharges more likely to occur between the sheet and the first static eliminating sheet 33.

As a result, unfixed toner on the sheet may scatter and cause disturbances in a toner image. Or, scattered unfixed toner may attach to the first conveying guide 30, the second conveying guide 31, or a fixing member in the fixing portion 9 and then attach back to the following sheet, causing the electrostatic offset.

Thus, in this embodiment, in addition to the first static eliminating sheet 33 attached to the guide plate 30*a*, a second static eliminating sheet 35 is attached to the resin second conveying guide 31. The second conveying guide 31 and the second static eliminating sheet 35 constitute a second static eliminating member 41 used in this embodiment. The second static eliminating sheet 35 is attached to the second conveying guide 31, over the entire region of the second conveying guide 31 in its width direction such that the second static eliminating sheet 35 and a sheet that passes through the second conveying guide 31 are kept in a non-contact state. As a material of the second static eliminating sheet 35, as in the first static eliminating sheet 33, an electrically conductive nonwoven fabric or the like is used.

The sheet on which a toner image has been transferred at the transfer nip portion N approaches the second static eliminating sheet 35 (a second static eliminating member 41) on the upstream side in the sheet conveying direction. The second static eliminating sheet 35 is attached to the resin second conveying guide 31, and so the electric charge capacity of the second static eliminating member 41 just equals the electric charge capacity of the second static eliminating sheet 35 itself. With the electric charge capacity smaller than that of the first static eliminating member 40, the second static eliminating sheet 35 can remove residual electric charges on the sheet to some extent without causing any disturbance in a toner image.

The sheet that has passed the second static eliminating sheet 35 (second static eliminating member 41) approaches the first static eliminating sheet 33 (first static eliminating member 40) attached on the downstream side in the sheet conveying direction. The first static eliminating sheet 33 is attached to the metal guide plate 30*a*, and so the first static eliminating member 40 has a larger electric charge capacity than that of the second static eliminating member 41, and thus exerts a larger static eliminating effect. By the time the sheet reaches the first static eliminating sheet 33, residual electric charges on the sheet have been removed to some extent by the second static eliminating sheet 35 (second static eliminating member 41). With this, it is possible to prevent micro-discharges from occurring between the first static eliminating sheet 33 attached to the metal guide plate 30*a* and the sheet.

In addition, the guide plate 30*a* is grounded via the resistor 37 with a high resistance ($10^6\Omega$ or higher), and this permits little current to flow from the guide plate 30*a* to the ground. With this, it is possible to prevent micro-discharges from occurring between the first static eliminating sheet 33 and the sheet even more effectively.

Figure 5:
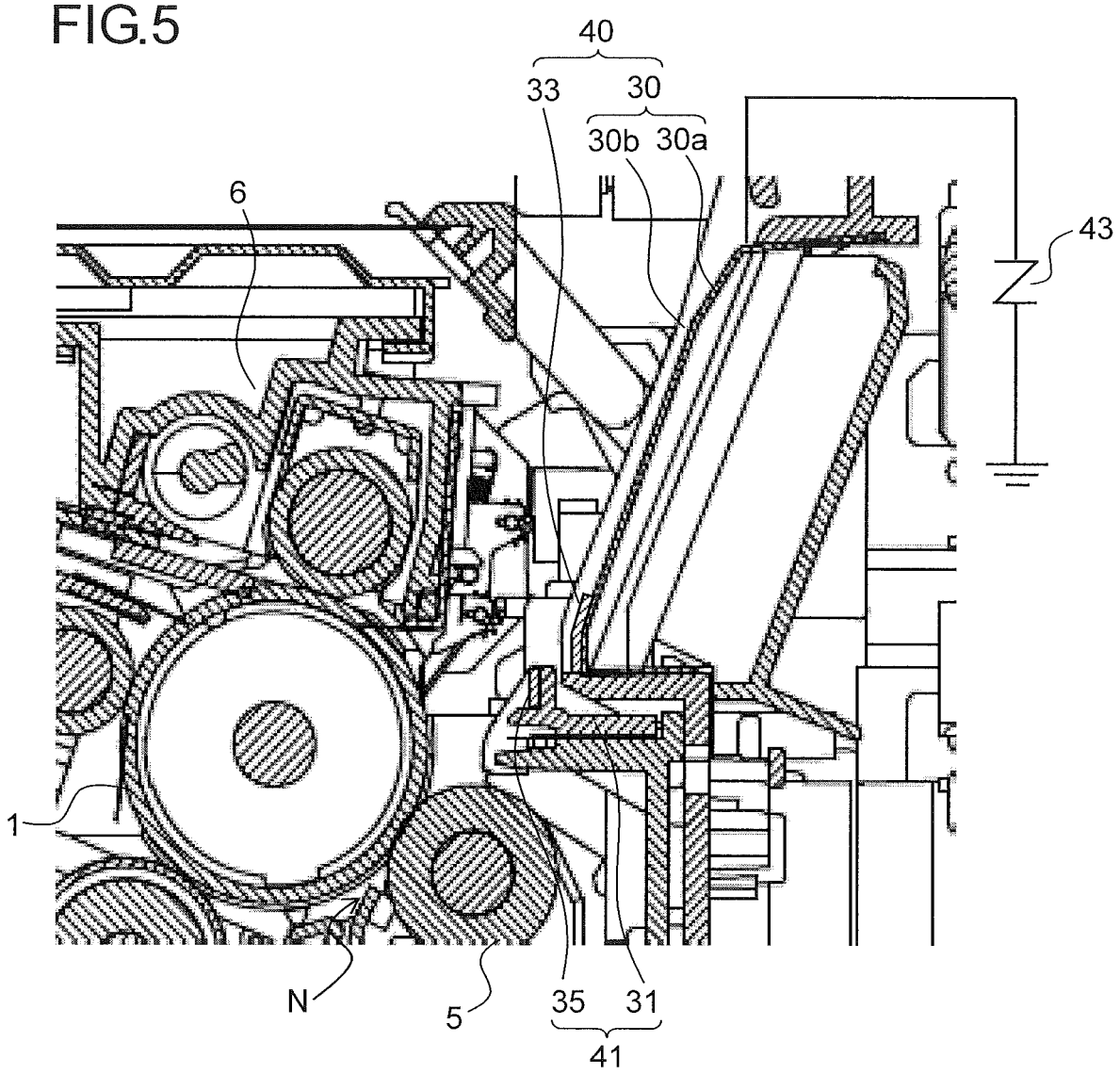
FIG. 5 shows a modified example of the image forming apparatus according to the first embodiment, and is an enlarged cross-sectional view of and around the first conveying guide and the second conveying guide, showing a structure where a guide plate is grounded via a varistor.

Here, the guide plate 30*a* is grounded via the resistor 37 with a high resistance ($10^6\Omega$ or higher); instead of the resistor 37, as shown in FIG. 5, a varistor 43 may also be used. The varistor 43 is an electronic component with two electrodes, and has such characteristics that its electrical resistance, while being high when the voltage between the two electrodes is low, sharply lowers when the voltage becomes higher than a certain value. Grounding the guide plate 30*a* via the varistor 43, as with the resistor 37, makes it difficult for current to flow from the guide plate 30*a* to the ground, and thus it is possible to effectively prevent micro-discharges from occurring between the first static eliminating sheet 33 and a sheet.

The second static eliminating sheet 35 is attached to the resin second conveying guide 31, and thus there is no risk that micro-discharges occur between the second static eliminating sheet 35 and a sheet.

The second static eliminating sheet 35 can not only remove residual electric charges on a sheet but also remove electric charges accumulated in the electrically non-conductive resin second conveying guide 31 by self-discharge. It thus also exerts an effect of eliminating disturbance in a toner image and variation of the sheet conveying state due to excess electric charges on the resin second conveying guide 31.

Figure 6:
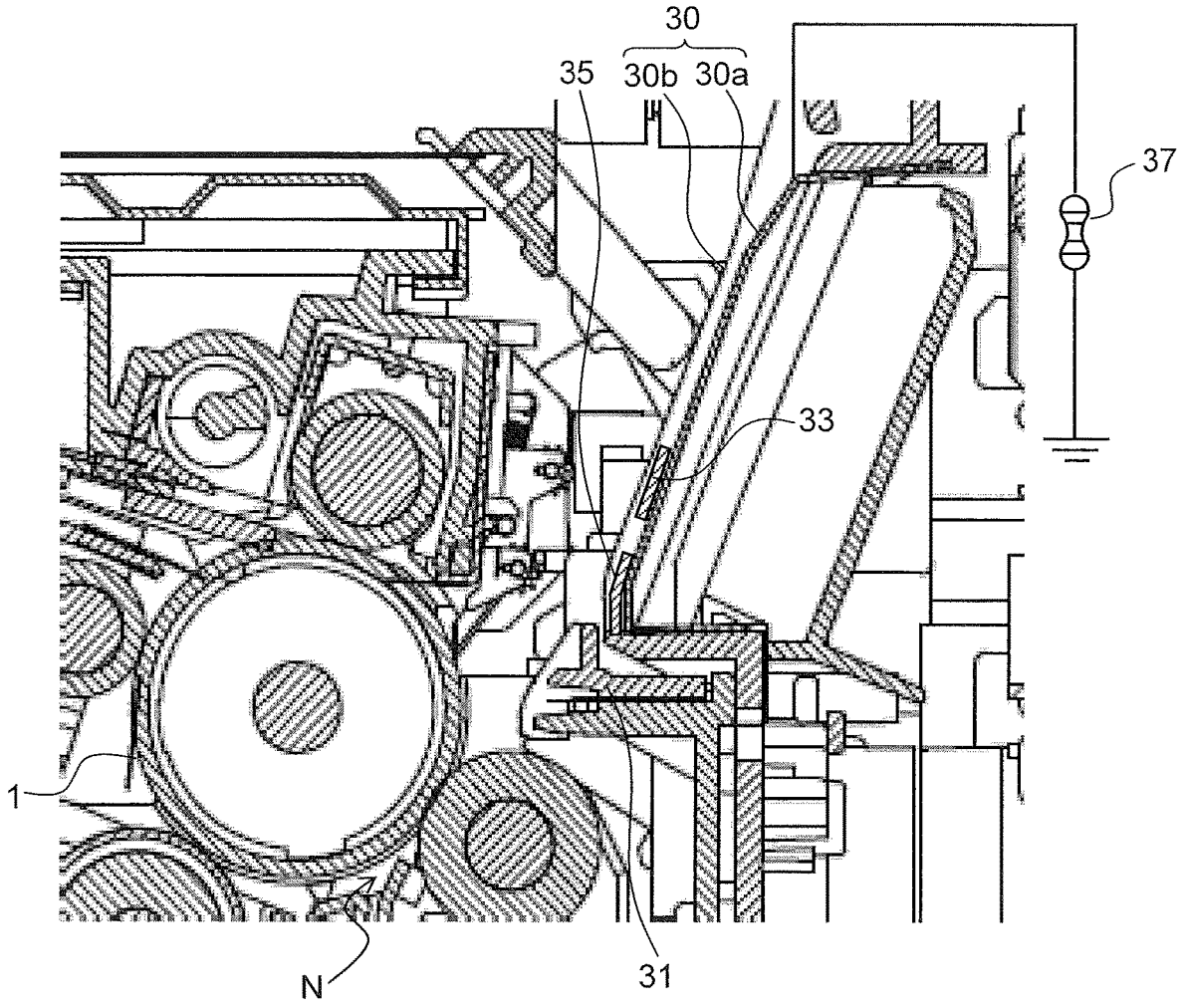
FIG. 6 is an enlarged cross-sectional view of and around a first conveying guide and a second conveying guide in an image forming apparatus according to a second embodiment of the present disclosure.
Figure 7:
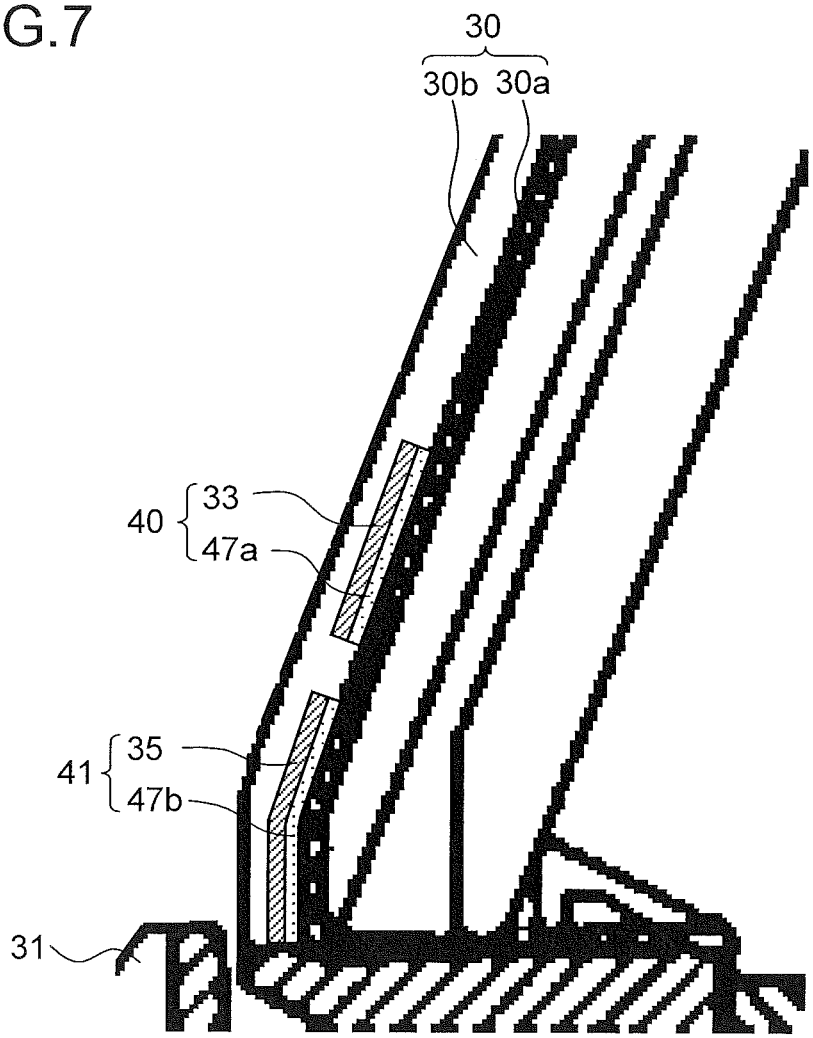
FIG. 7 is an enlarged view of a first static eliminating sheet and a second static eliminating sheet in FIG. 6.

FIG. 6 is an enlarged cross-sectional view of and around a first conveying guide 30 and a second conveying guide 31 in an image forming apparatus 100 according to a second embodiment of the present disclosure. FIG. 7 is an enlarged view of a first static eliminating sheet 33 and a second static eliminating sheet 35 in FIG. 6. In this embodiment, a static eliminating sheet attached to a metal guide plate 30*a* is divided into the first static eliminating sheet 33 and the second static eliminating sheet 35, the latter being attached on the upstream side of the former in the sheet conveying direction. The material of the first static eliminating sheet 33 and the second static eliminating sheet 35, and also the grounding structure of the guide plate 30*a*, is similar to that in the first embodiment shown in FIGS. 4 and 5.

As shown in FIG. 7, the first static eliminating sheet 33 is attached to the first conveying guide 30 using an electrically conductive double-sided tape 47*a*. The second static eliminating sheet 35 is attached to the first conveying guide 30 using an electrically insulating double-sided tape 47*b* (insulating member). The first static eliminating sheet 33 and the electrically conductive double-sided tape 47*a* (electrically conductive member) constitute the first static eliminating member 40 used in this embodiment. The second static eliminating sheet 35 and the electrically insulating double-sided tape 47*b* constitute the second static eliminating member 41 used in this embodiment.

The sheet on which a toner image has been transferred at a transfer nip portion N approaches the second static eliminating sheet 35 (a second static eliminating member 41) attached on the upstream side in the sheet conveying direction. The second static eliminating sheet 35 is attached to the guide plate 30*a* in an electrically insulated state, and so the electric charge capacity of a second static eliminating member 41 just equals the electric charge capacity of the second static eliminating sheet 35 itself. With the electric charge capacity smaller than that of the first static eliminating member 40, the second static eliminating sheet 35 can remove residual electric charges on the sheet to some extent without causing any disturbance in a toner image.

The sheet that has passed the second static eliminating sheet 35 (second static eliminating member 41) approaches the first static eliminating sheet 33 (first static eliminating member 40) attached on the downstream side in the sheet conveying direction. The first static eliminating sheet 33 is attached to the guide plate 30*a* in an electrically conductive state, and so the first static eliminating member 40 has a larger electric charge capacity than that of the second static eliminating member 41, and thus exerts a larger static eliminating effect. Residual electric charges on a sheet have been removed by the second static eliminating member 41 to some extent, and thus it is possible to prevent micro-discharges from occurring between the first static eliminating sheet 33 and the sheet.

The embodiments described above are in no way meant to limit the present disclosure, which thus allows for many modifications and variations within the spirit of the present disclosure. For example, although the embodiments described above deal with a means for removing residual electric charges on a sheet with the first static eliminating member 40 and the second static eliminating member 41 in a direct transfer system where a toner image formed on the photosensitive drum 1 is transferred directly to a sheet, residual electric charges on the sheet on which a toner image has been transferred can be removed with the first static eliminating member 40 and the second static eliminating member 41 also in an intermediate transfer system where toner images in different colors formed on a plurality of photosensitive drums are primarily transferred to an intermediate transfer belt to make a full-color image, and then the full-color image formed on the intermediate transfer belt is secondarily transferred to the sheet.

In the embodiments described above, the first static eliminating member 40 and the second static eliminating member 41 are formed by attaching the first static eliminating sheet 33 and the second static eliminating sheet 35 made of an electrically conductive nonwoven fabric or the like to the first conveying guide 30 or the second conveying guide 31. Instead, three or more static eliminating sheets can be attached to the first conveying guide 30 or the second conveying guide 31 so that the electric charge capacity of a static eliminating member arranged on the downstream side in the sheet conveying direction is larger than that of the static eliminating member arranged on the upstream side.

The image forming apparatus according to the present disclosure is not limited to a monochrome printer as shown in FIG. 1; it may instead be any other image forming apparatus, such as a monochrome or color copier, a digital multifunction peripheral, a color printer, or a facsimile machine, that is provided with a conveying guide for a sheet being conveyed from a transfer portion to a fixing portion.

The present disclosure is applicable to an image forming apparatus provided with a conveying guide for conveying to a fixing portion a recording medium such as a sheet on which a toner image on an image carrier has been transferred. Based on the present disclosure, it is possible to provide an image forming apparatus that can remove residual electric charges on a recording medium without causing micro-discharges between the recording medium and a static eliminating member.

What is claimed is:

1. An image forming apparatus, comprising:

an image carrier which carries a toner image;

a transfer portion which transfers the toner image formed on the image carrier to a recording medium;

a fixing portion which fixes the toner image transferred by the transfer portion to the recording medium;

a recording medium conveying passage through which the recording medium conveyed from the transfer portion to the fixing portion passes; and a plurality of static eliminating members which are arranged in the recording medium conveying passage along a conveying direction of the recording medium in a non-contact state with the recording medium, wherein the static eliminating member arranged on a downstream side in the conveying direction of the recording medium has a larger electric charge capacity than an electric charge capacity of the static eliminating member arranged on an upstream side, the conveying passage includes a conveying guide formed of an electrically conductive material, and the static eliminating member includes a first static eliminating member composed of a first static eliminating sheet attached to the conveying guide and an electrically conductive member which lies between the first static eliminating sheet and the conveying guide, and a second static eliminating member composed of a second static eliminating sheet attached to the conveying guide on an upstream side of the first static eliminating sheet in the conveying direction of the recording medium and an electrically insulating member which lies between the second static eliminating sheet and the conveying guide.

2. The image forming apparatus according to claim 1, wherein the conveying guide has a metal guide plate and a resin guide rib arranged so as to protrude from a surface of the guide plate, and the first static eliminating sheet is attached to the guide plate via the electrically conductive member and the second static eliminating sheet is attached to the guide plate via the electrically insulating member.

3. The image forming apparatus according to claim 1, wherein the conveying guide is grounded via a resistor having a resistance value of an order of megohms.

4. The image forming apparatus according to claim 1, wherein the conveying guide is grounded via an electronic component having such a characteristic that electrical resistance thereof lowers when a voltage becomes higher than a predetermined value.

5. The image forming apparatus according to claim 1, wherein the first conveying guide has a metal guide plate and a resin guide rib arranged so as to protrude from a surface of the guide plate, and the first static eliminating sheet is attached to an upstream-side end part of the guide plate in the conveying direction of the recording medium.

6. The image forming apparatus according to claim 5, wherein a plurality of the guide ribs are arranged at predetermined intervals in a width direction perpendicular to the conveying direction of the recording medium, and the first static eliminating sheet is attached to the first conveying guide over the entire region of the first conveying guide in the width direction so as to fill gaps between the guide ribs.

* * * * *